US012102899B2

(12) United States Patent
Coulter et al.

(10) Patent No.: US 12,102,899 B2
(45) Date of Patent: Oct. 1, 2024

(54) SPORTS REBOUNDING AND GOAL APPARATUS

(71) Applicant: Dick's Sporting Goods, Inc., Coraopolis, PA (US)

(72) Inventors: Derek Coulter, Coraopolis, PA (US); Lucas Ferrari, Clinton, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 62 days.

(21) Appl. No.: 16/845,408

(22) Filed: Apr. 10, 2020

(65) Prior Publication Data

US 2021/0316199 A1 Oct. 14, 2021

(51) Int. Cl.
*A63B 69/00* (2006.01)
*A63B 63/00* (2006.01)
*A63B 102/14* (2015.01)

(52) U.S. Cl.
CPC ..... *A63B 69/0097* (2013.01); *A63B 63/004* (2013.01); *A63B 2063/001* (2013.01);
(Continued)

(58) Field of Classification Search
CPC ..... A63B 69/0097; A63B 63/004; A63B 2102/14; A63B 69/002; A63B 69/0024; A63B 2063/001; A63B 2210/50
(Continued)

(56) References Cited

U.S. PATENT DOCUMENTS 1,701,206 A * 2/1929 Haboush ..... G09F 15/0012 40/610
D265,413 S 7/1982 Millikan
(Continued)

FOREIGN PATENT DOCUMENTS

GB 2496642 A * 5/2013 ..... A63B 69/3623
KR 101248407 B1 4/2013

OTHER PUBLICATIONS

Fielding Trainer, <https://sklz.implus.com/products/baseball/sklz-fielding-trainer>, printed from internet Apr. 9, 2020.
(Continued)

*Primary Examiner* — Melba Bumgarner
*Assistant Examiner* — Amir A Klayman
(74) *Attorney, Agent, or Firm* — Foley & Lardner LLP

(57) ABSTRACT

A sports rebounding and goal apparatus for receiving a moving object, such as a ball, or puck having a base frame with elongated base members, an upper frame connected to the base frame and having elongated supports and upper frame members pivotally connected to the base frame. A first lock pivotally joins the supports and is selectively actuatable between a locked configuration to fix relative movement between the elongated supports and an unlocked configuration to allow folding movement of the supports relative to each other and relative to the first lock. Elongated cross members are pivotally connected to the upper frame and slidingly connected to base frame. A second lock pivotally connects at least one of the cross members and is selectively actuatable between a locked configuration to fix relative movement between the cross members and an unlocked position to allow drawing together of the cross members.

17 Claims, 6 Drawing Sheets

(52) U.S. Cl.
CPC ..... *A63B 69/002* (2013.01); *A63B 69/0024* (2013.01); *A63B 2102/14* (2015.10); *A63B 2210/50* (2013.01)

(58) Field of Classification Search
USPC ..... 473/478
See application file for complete search history.

(56) References Cited

U.S. PATENT DOCUMENTS

| | | | | |
|---|---|---|---|---|
| D279,911 | S | 7/1985 | Thompson | |
| 4,717,201 | A * | 1/1988 | Barras | A47C 4/38 297/16.2 |
| D302,991 | S | 8/1989 | York | |
| 4,905,996 | A * | 3/1990 | Tallent | A63B 63/00 473/197 |
| 5,048,844 | A | 9/1991 | Haseltine | |
| D353,424 | S | 12/1994 | Way | |
| D356,841 | S | 3/1995 | Temple | |
| 5,558,338 | A | 9/1996 | Taub | |
| 5,681,045 | A * | 10/1997 | Liao | A63B 63/004 403/92 |
| 5,772,537 | A * | 6/1998 | Anderson | A63B 69/0097 273/396 |
| 5,976,026 | A * | 11/1999 | Erb | A63B 69/0002 473/270 |
| 6,209,877 | B1 | 4/2001 | Warnick | |
| D462,733 | S | 9/2002 | Smith, IV | |
| 6,625,826 | B1 | 9/2003 | Cheng | |
| 6,672,980 | B1 * | 1/2004 | Walsh | A63B 69/0097 473/478 |
| D496,422 | S | 9/2004 | Rota | |
| 7,249,767 | B1 | 7/2007 | Gorton | |
| 7,462,114 | B2 | 12/2008 | Moller, Jr. | |
| D585,949 | S | 2/2009 | Gaudin et al. | |
| 7,914,402 | B2 | 3/2011 | Gaudin et al. | |
| 8,647,221 | B1 | 2/2014 | Hochberg | |
| 8,651,979 | B2 | 2/2014 | Chen | |
| 8,758,173 | B2 | 6/2014 | Goodman | |
| 8,900,074 | B1 | 12/2014 | Johnson et al. | |
| 9,120,000 | B2 | 9/2015 | Weston | |
| 9,227,123 | B2 | 1/2016 | DeBolt et al. | |
| 9,227,126 | B2 | 1/2016 | Christgau et al. | |
| 9,339,711 | B2 | 5/2016 | Goodman | |
| D779,602 | S | 2/2017 | Hochberg | |
| 9,586,117 | B2 | 3/2017 | Freund | |
| 9,808,697 | B2 | 11/2017 | Dorsett | |
| 9,908,023 | B1 | 3/2018 | Hamm et al. | |
| D833,547 | S | 11/2018 | Weber | |
| 10,166,453 | B1 | 1/2019 | Dickerson | |
| 10,507,372 | B1 | 12/2019 | Dickerson | |
| 2007/0176369 | A1 | 8/2007 | Sellke | |
| 2016/0199718 | A1 | 7/2016 | Holland et al. | |
| 2018/0353835 | A1 | 12/2018 | Goldwitz | |
| 2021/0060396 | A1 * | 3/2021 | Fedon | A63B 69/002 |

OTHER PUBLICATIONS

Kwik Goal Rebounder, https://www.soccer.com/shop/details/kwik-goal-rebounder_A1026022?gclid=Cj0KCQiAiZPvBRDZARIsAORkq7eEgXZJkvqu3MCoLulQ7MYCzFkNIqpl3cuoM7JSbh22bU4XNAXOlhcaAomLEALw_wcB&gclsrc=aw.ds, printed from internet Apr. 9, 2020.

Ball rebounder, https://www.swimoutlet.com/p/mikasa-shot-maker-ball-rebounder-12590/?&utm_source=google&utm_medium=cpc&utm_campaign=google-shopping&campaignid=1670648331&adgroupid=67569747074&keyword=&matchtype=&targetid=pla-438030653243&device=c&creativeid=323297639731&adposition=1o3&gclid=Cj0KCQiAiZPvBRDZARIsAORkq7ejBRmh9j0zel-3EdzJB-xUJI1tkvdJc-exraqGfhbTIkXiHCUDytoaAsHIEALw_wcB, printed from internet Apr. 9, 2020.

* cited by examiner

SPORTS REBOUNDING AND GOAL APPARATUS

BACKGROUND

The disclosure relates generally to a sports rebounding and goal apparatus for receiving a moving object, such as a ball, hockey puck, or the like.

Ball rebounders are often used to help develop and enhance a player's skills in shooting accuracy, ball touch, dribbling, passing, and ball control, etc. Rebounders, and also goals, can be relatively large, some being in the range of twelve feet by six feet and larger, and as such, may present problems when transporting and storing. While smaller scale devices are available, they can still be relatively bulky and awkward to move and store in a space-efficient manner.

Accordingly, providing a sports rebounding and goal apparatus that can be manipulated to be in a compact, space-saving configuration may be desirable.

SUMMARY

Generally, an example implementation of the present disclosure may include an apparatus having a base frame having elongated base members, an upper frame connected to the base frame, and elongated upper frame members pivotally connected to the base frame, with the upper frame having elongated supports. A first lock is configured to pivotally join together the supports and to be selectively actuatable between a locked configuration to fix relative movement between the elongated supports and an unlocked configuration to allow folding movement of the supports relative to each other and relative to the first lock. Elongated cross members are pivotally connected to the upper frame and slidingly connected to base frame. A second lock is pivotally connected to at least one of the cross members and is configured to be selectively actuatable between a locked configuration to fix relative movement between the cross members and an unlocked position to allow drawing together of the cross members.

Other example implementations of the present disclosure include at least one elongated brace being pivotally connected to the upper frame and slidingly connected to the base frame, where the brace is configured to slide on the base frame upon folding movement of the supports and/or where the brace is configured to be selectively extendable along its length, for example, by selectively telescoping in length.

Example implementations of the present disclosure may also provide, upon the first lock being in the unlocked configuration and the second lock being in the unlocked configuration, the supports being configured to be substantially folded together, the cross members being configured to be drawn together, the base members being configured to be drawn substantially together, and the upper frame members being configured to be drawn substantially together.

Further example implementations of the present disclosure may also include a net connected to the upper frame.

In other example implementations of the present disclosure, an apparatus is provided that includes an elongated upper frame configured to define an opening, an elongated base frame connected to the upper frame and having an elongated first base member and an elongated second base member. The upper frame includes an elongated upper support having a first end and a second end opposite the first end, an elongated first side support, and an elongated second side support. The first end of the upper support is pivotally connected to the first side support, and the second end of the upper support is pivotally connected to the second side support. Each of the first side support and the second side support are configured to move between a first position substantially perpendicular to the upper support and a second position generally parallel to at least a portion of the upper support. The first side support is configured to move between a first position substantially perpendicular or at an acute angle with respect to the first base member and a second position generally parallel to the first base member. And, the second side support is configured to move between a first position substantially perpendicular or at an acute angle with respect to the second base member and a second position generally parallel to the second base member.

Implementations of the present disclosure may also provide the upper frame being configured to selectively extend perpendicularly with respect to the base frame, at an acute angle with respect to the base frame, and substantially parallel to the base frame.

Certain implementations of the present disclosure may also provide the first side support being configured to move to a third position where the first side support extending substantially parallel to the first base member.

Certain implementations of the present disclosure may also provide the second side support being configured to move to a third position where the second side support extends substantially parallel to the second base member.

Other implementations of the present disclosure may further include the upper support having an elongated first upper support member and an elongated second upper support member, with each of the first upper support and second upper support member having a first end and a second end opposite the first end, and the first end of the first upper support being connected to the second side support member. An upper support locking mechanism is pivotally connected to the second end of the first upper support member and the second end of the second upper support member, and the upper support locking mechanism is configured to be actuatable between a locked position, where the first upper support member and the second upper support member are fixed with respect to one another, and an unlocked position, where at least one of the second end of the first upper support member and the second end of the second upper support members is pivotable with respect to the upper support locking mechanism.

Some implementations of the present disclosure may provide the upper support locking mechanism being a selectively actuatable toggle mechanism.

Additional implementations of the present disclosure may further include a first cross support having a first end pivotally connected to at least one of the first base member and the upper frame and slidingly connected to the second base member. A second cross support has a first end pivotally connected to at least one of the second base member and the upper frame and is slidingly connected to the first base member.

Further implementations of the present disclosure may include a first cross support having a first end pivotally connected to at least one of the first base member and the upper frame and slidingly connected to the second base member. A second cross support has a first end pivotally connected to at least one of the second base member and the upper frame and is slidingly connected to the first base member. A cross support locking mechanism is connected to the second cross support and is configured to selectively lock the second cross support against relative movement with respect to the first cross support.

Implementations of the present disclosure may further include a first cross support having a first end pivotally connected to at least one of the first base member and the upper frame and slidingly connected to the second base member. A second cross support includes an elongated first leg pivotally connected to at least one of the second base member and the upper frame and an elongated second leg slidingly connected to the first base member. A cross member locking mechanism is connected to the first leg and the second leg and is configured to selectively fix relative movement between the first cross support and at least one of the first leg and the second leg.

Implementations of the present disclosure may provide the cross member locking mechanism including a selectively spring-biased locking button.

Yet further implementations of the present disclosure may include a first brace member pivotally connected to the first side support and slidingly connected to the first base member, and, a second brace member pivotally connected to the second side support and slidingly connected to the second base member.

Still further implementations of the present disclosure may include a first brace member pivotally connected to the first side support and slidingly connected to the first base member, and, a second brace member pivotally connected to the second side support and slidingly connected to the second base member. Each of the first brace member and the second brace member has a first sleeve and a second sleeve slidingly received within the first sleeve configured to allow the length of each of the first brace and the second brace to be selectively adjusted. In certain example implementations, at least one of the first brace member and the second brace member has a lock device for selectively fixing the first sleeve with respect to the second sleeve.

Other implementations of the present disclosure may include a net configured to be connected to the upper frame and to span across the opening and to rebound the object. Additional implementations of the present disclosure include a method for receiving a moving object, including the steps of providing a base frame having elongated base members and an upper frame connected to the base frame and having a net, elongated upper frame members pivotally connected to the base frame, and elongated supports; providing elongated cross members pivotally connected to the upper frame or the base frame and slidingly connected to the base frame; providing a first lock selectively actuatable between a locked configuration and an unlocked position, the first lock pivotally joining together the supports; actuating the first lock to an unlocked configuration; folding the supports relative to each other; providing a second lock selectively actuatable between a locked configuration and an unlocked position, the second lock pivotally joining together the cross members; actuating the second lock to an unlocked configuration; and drawing together the cross members relative to each other.

Other implementations of the present disclosure include a method having the steps of: providing at least one elongated brace pivotally connected to the upper frame and slidingly connected to the base frame; sliding the brace on the base frame substantially simultaneously with the drawing together of the cross members; drawing together the base members substantially simultaneously with the drawing together of the cross members; and drawing together the upper frame members substantially simultaneously with the drawing together of the cross members and the folding of the supports.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some implementations, the term "approximately" may include values that are within +/−10 percent of the value.

When used in this document, terms such as "top" and "bottom," "above" and "below", "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

Figure 1:
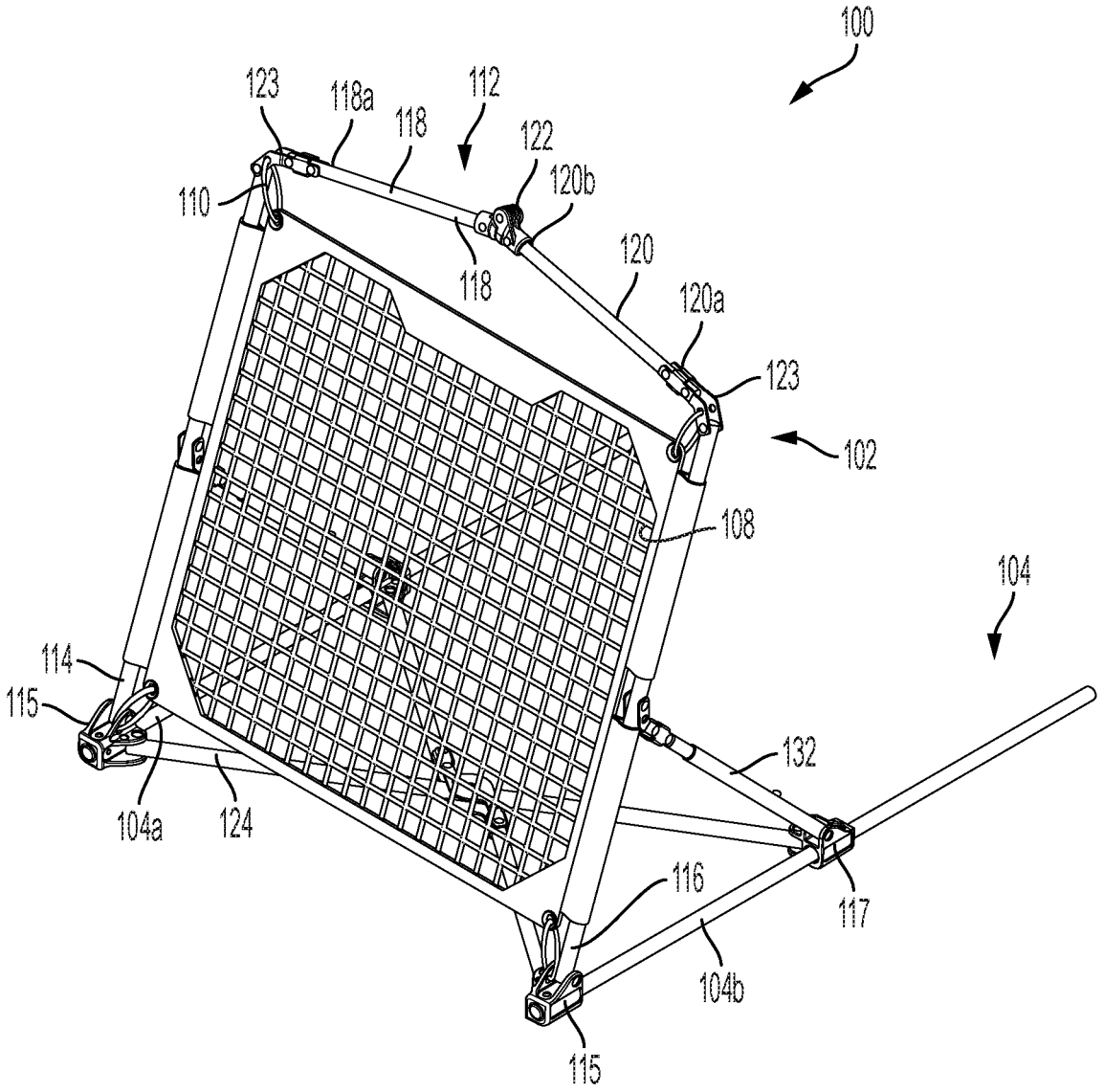
FIG. 1 is a front perspective view of an example implementation of a sports rebounding and goal apparatus of the present disclosure.
Figure 6:
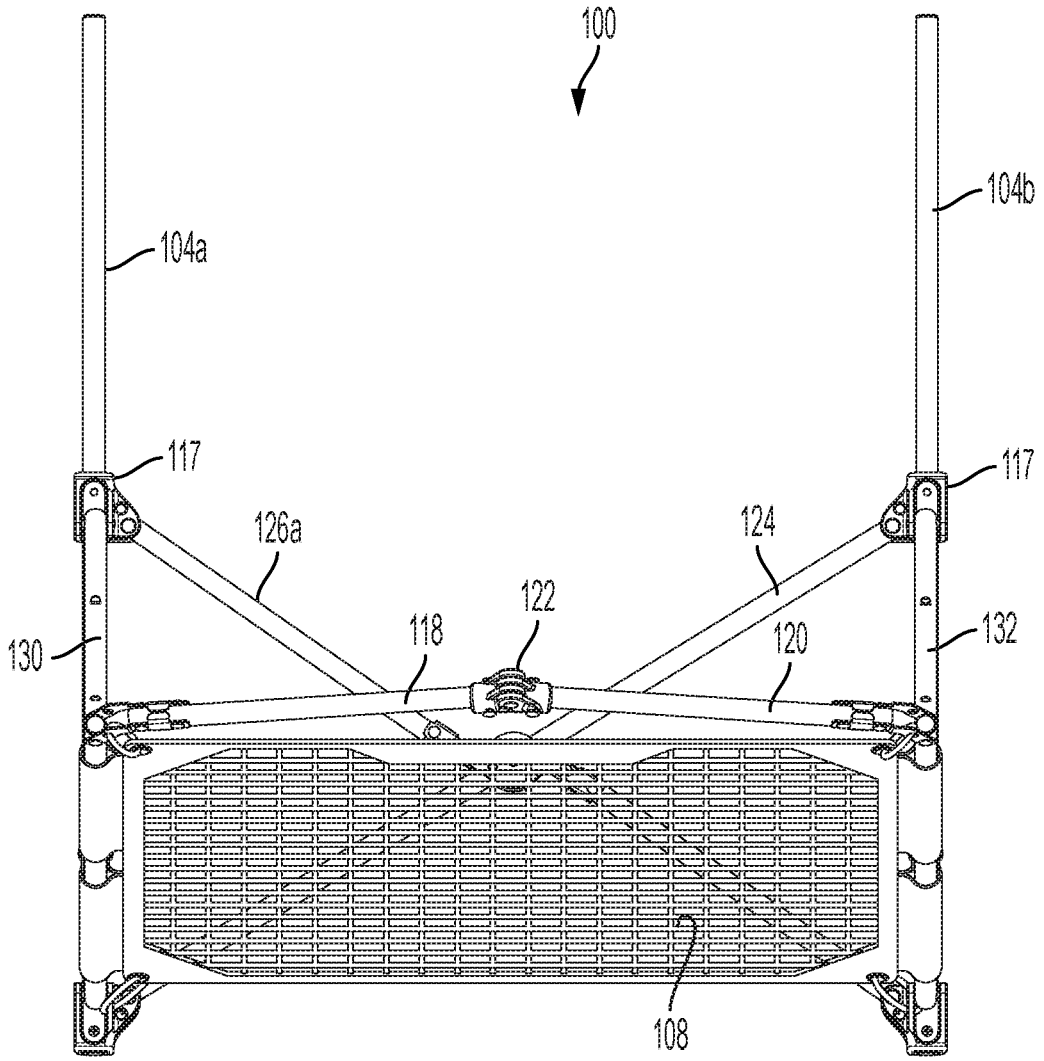
FIG. 6 is a top plan view of an example implementation of a sports rebounding and goal apparatus of the present disclosure.

FIGS. 1 and 6 present an example implementation of a sports rebounding and goal apparatus, or "rebounder," generally 100, in accordance with the present disclosure. Rebounder 100 includes a first, or upper, frame 102 connected to a second, or base, frame 104. Base frame 104 includes elongated first and second base members 104*a*, 104*b* that extend behind and generally perpendicular, or at an acute angle, with respect to upper frame 102. Upper frame 102 defines an open area 106 (FIG. 2), and a net 108 that is configured to be connected by one or more connectors, such as straps, hooks, or the like, generally 110, to upper frame 102 and to base frame 104 and to also span across at least a portion of open area 106 for use in rebounding balls, pucks, or the like propelled against net 108.

Upper frame 102 includes an elongated upper support, generally 112, having a first end and a second end opposite the first end. An elongated first side support 114 is pivotally connected to first end of upper support 112 and is pivotally connected to first base member 104*a* via pivotal connector 115. An elongated second side support 116 is pivotally connected to the second end of upper support 112 and is pivotally connected to second base member 104*b* via pivotal connector 115, which in an example implementation may be a knuckle connector.

Figure 4:
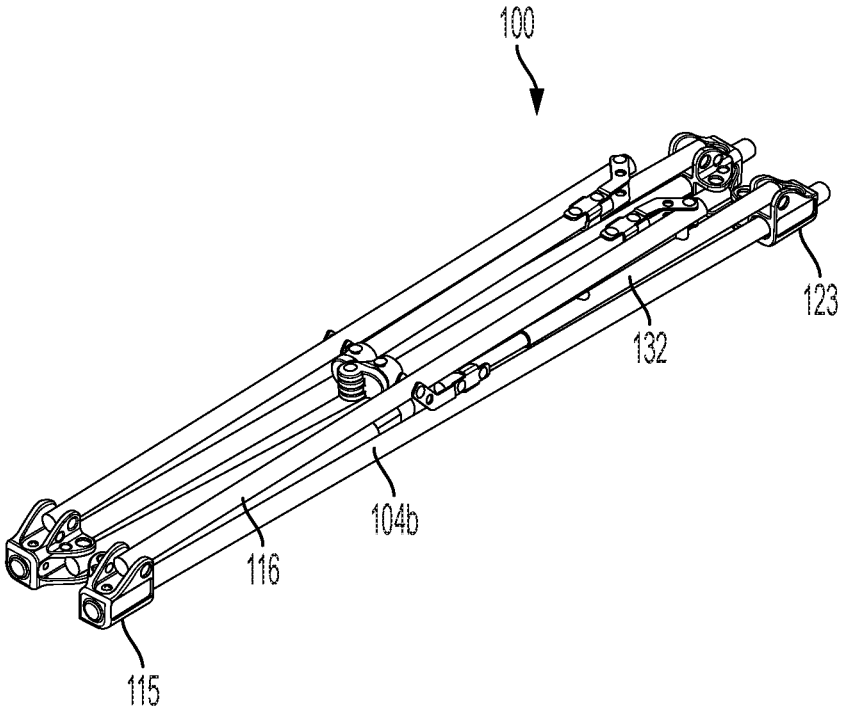
FIG. 4 is a perspective view of an example implementation of a sports rebounding and goal apparatus of the present disclosure in a collapsed configuration.
Figure 5:
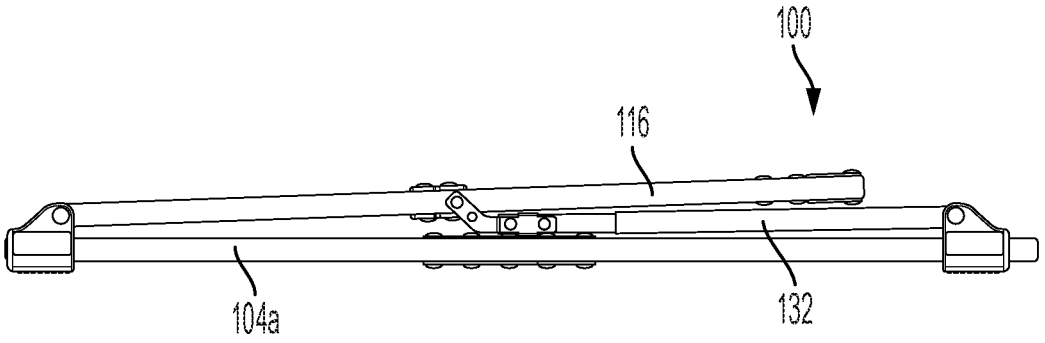
FIG. 5 is a side elevational view of an example implementation of a sports rebounding and goal apparatus of the present disclosure in a collapsed configuration.

Each of the first and second side supports 114, 116 may be configured to move between a first position substantially perpendicular to base frame 104 (FIGS. 1, 2, and 6) and a second position generally parallel to at least a portion of upper support 112 (FIGS. 4 and 5).

First side support 114 may also be configured to move between a first position, where first side support 114 extends substantially perpendicular to first base member 104*a*, a second position where first side support 114 extends at an acute angle with respect to first base member 104*a*, and a third, collapsed, position wherein first side support 114 extends substantially parallel to first base member 104*a* Similarly, second side support 116 may be configured to move between a first position, where second side support 116 extends substantially perpendicular to second base member 104*b*, a second position wherein second side support 116 extends at an acute angle with respect to second base member 104*b*, and a third, collapsed, position, where second side support 116 extends substantially parallel to second base member 104*b*.

Example implementations of rebounder 100 of the present disclosure may include upper support 112 comprising an elongated first upper support member 118 and an elongated second upper support member 120. Locking mechanism 122 connects first and second upper support members 118, 120 together.

First upper support member 118 includes a first end 118*a* and a second end 118*b* opposite first end 118*a* Similarly, second upper support member 120 includes a first end 120*a* and a second end 120*b* opposite first end 120*a*. First ends 118*a*, 120*a* of the first and second support members 118, 120, respectively, are pivotally connected to upper frame 102. Specifically, first end 118*a* of first upper support member 118 is pivotally connected to first side support member 114 with a pivotal connector, such as a hinge connector 123, and first end 120*a* of upper support member 120 is pivotally connected to side support member 116, also with a hinge connector 123.

Figure 2:
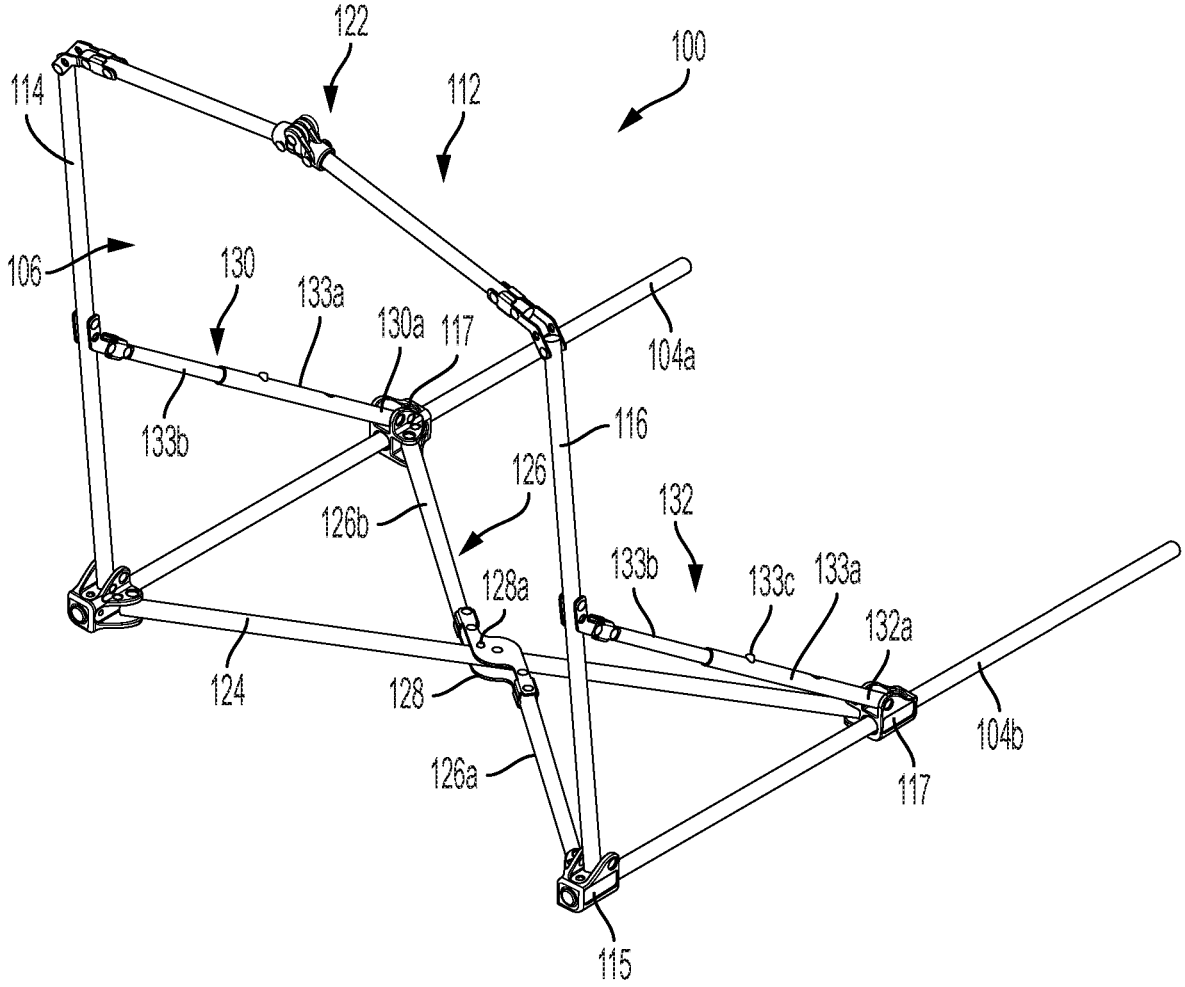
FIG. 2 is a schematic view of an example implementation of a sports rebounding and goal apparatus of the present disclosure.
Figure 3:
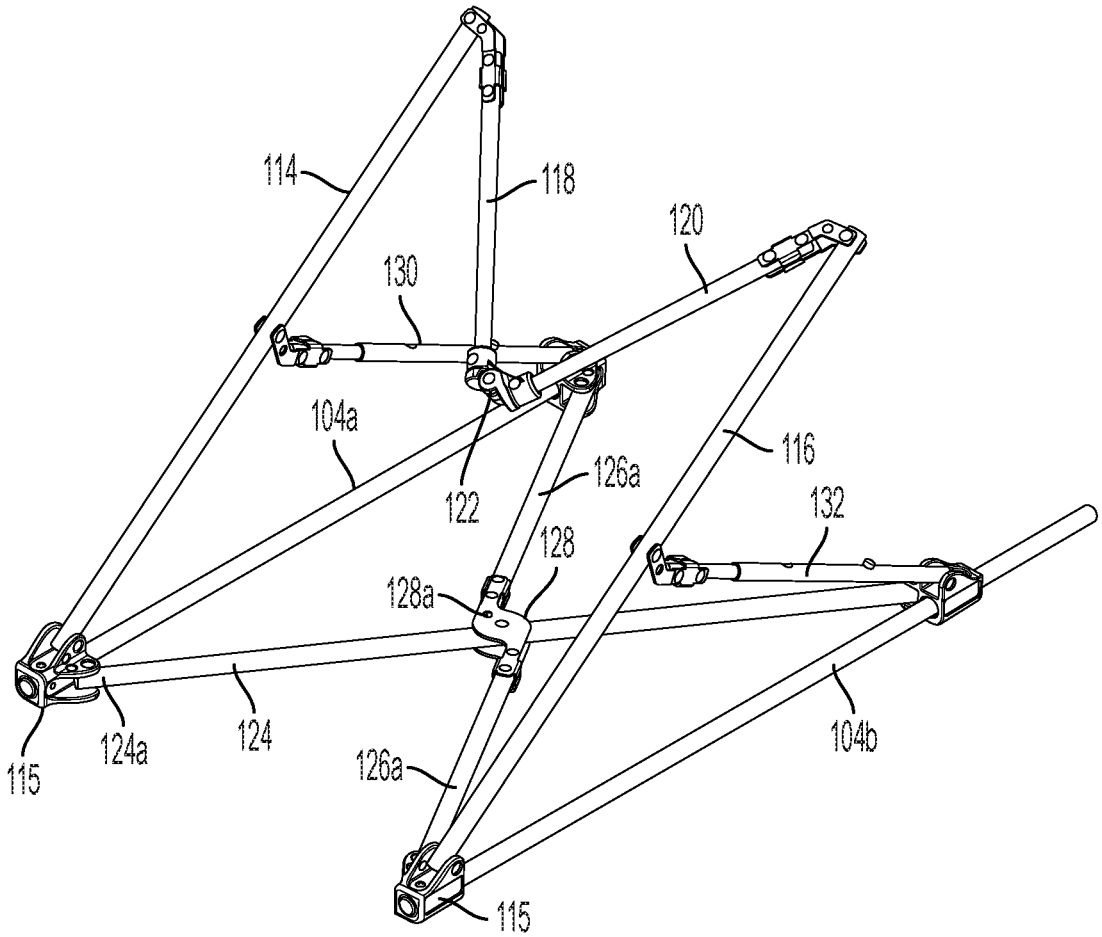
FIG. 3 is a front perspective view of an example implementation of a sports rebounding and goal apparatus of the present disclosure in a partially collapsed configuration.

Locking mechanism 122 is pivotally connected to each second end 118*b*, 120*b* of first and second upper support members 118, 120, and is actuatable between a locked position, where first and second upper support members 118, 120 are substantially rigidly fixed with respect to one another and are configured to hold net 108 in tension, as shown, for example, in FIGS. 1 and 6. Locking mechanism 122 is actuatable to an unlocked position, where at least one of the second ends 118*b*, 120*b* of the first and second upper support members 118, 120 is pivotable with respect to the locking mechanism 122. When in the unlocked position, locking mechanism 122 allows the second ends 118*b*, 120*b* of first and second upper support members 118, 120, to pivot downwardly, as shown in FIG. 3. In such a configuration, the tension in net 108 is reduced, allowing net 108 to become slack as compared to when locking mechanism 122 is in the locked position (FIGS. 1, 2 and 6).

Locking mechanism 122, which could be a of a variety of configurations, is in one example a toggle lock mechanism having a hinged coupling that is pulled upwardly to a tensioned over-center-toggle point which then induces compression in first and second upper supports 118, 120 (with respect to side supports 114, 116) sufficient to hold first and second upper supports 118, 120 in place in a generally rigid, end-to-end relationship. To release, or unlock, coupling 122, a user need only depress the locking mechanism 122 a sufficient distance whereby the members 118, 120 are no longer in tension, at which point members 118, 120 may freely pivot downwardly in a folding manner as shown in FIG. 3.

Figure 7:
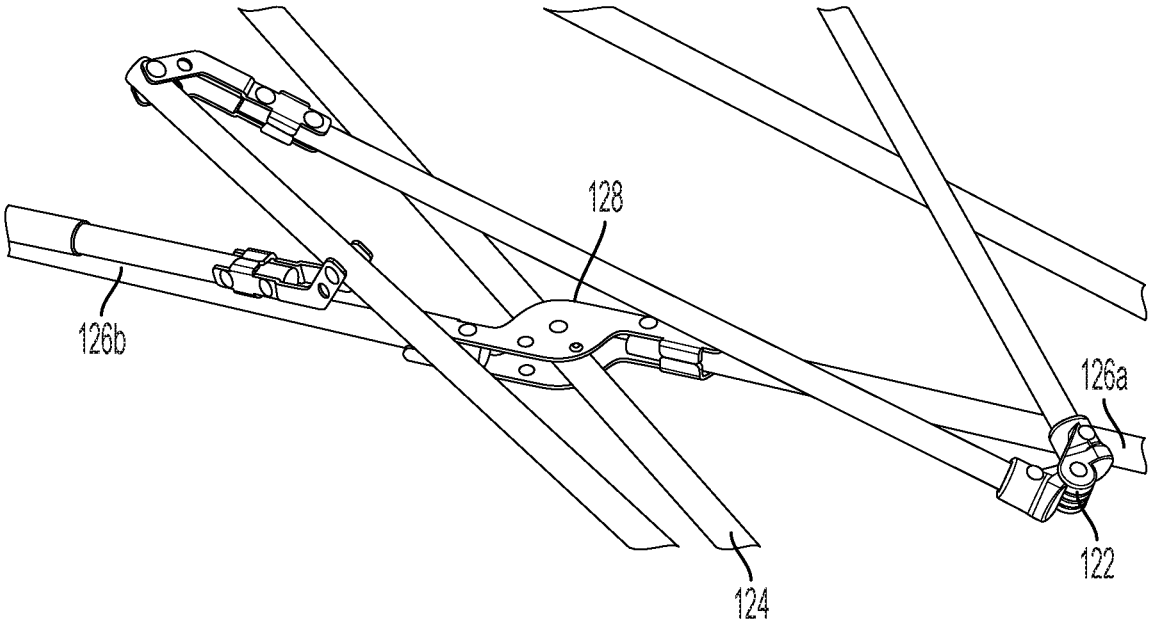
FIGS. 7 and 8 are schematic views of an example implementation cross member locking mechanism of a rebounder of the present disclosure.
Figure 8:
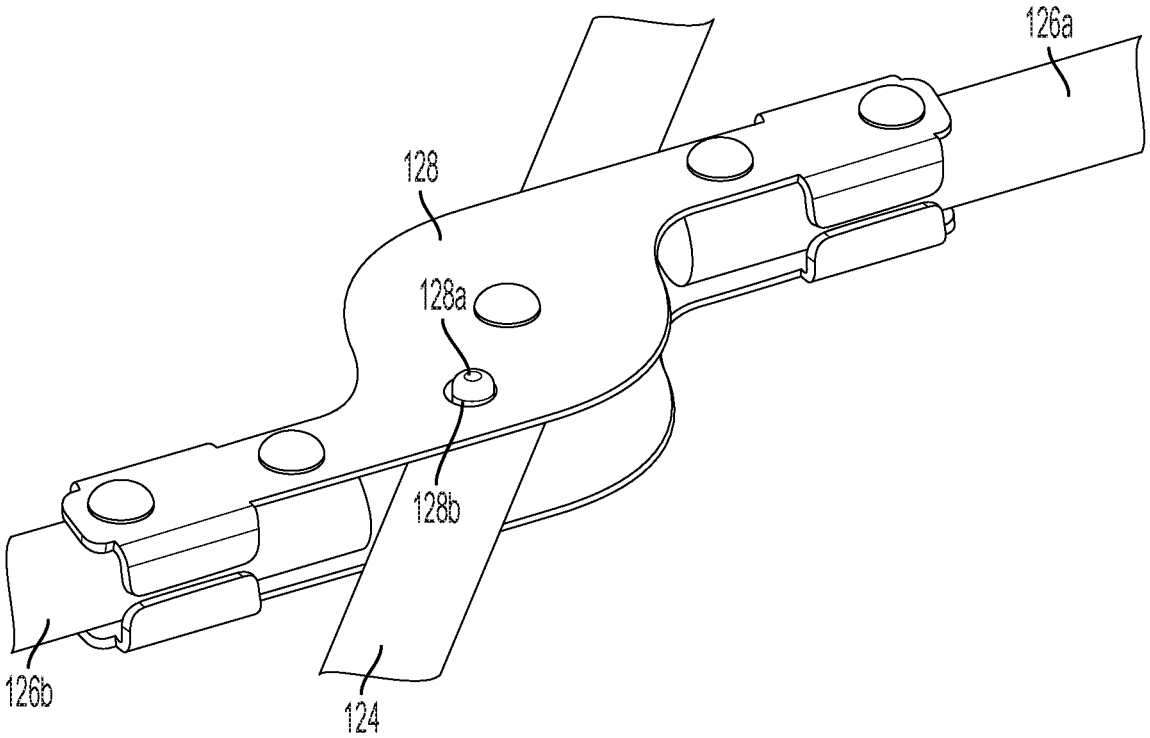

Rebounder 100 may also include first and second cross members, or supports, 124, 126, which each extend between first and second base members 104*a*, 104*b*. First support 124 is a single member and has an end 124*a* pivotally connected to first base member 104*a* via pivotal connector 115, and a second end connected for pivotally and/or slidingly movement to second base member 104*b* via sliding pivotal connector 117 during set up and collapsing of rebounder 100. Second cross member 126 has an elongated first leg 126*a* and an elongated second leg 126*b*. A cross support locking mechanism 128 receives first cross member 124 and first and second legs 126*a*, 126*b*. Each of first and second legs 126*a*, 126*b* has a first end and a second end opposite the first end. The first end of first leg 126*a* is pivotally connected to second base member 104*b* via sliding pivotal connector 117 during set up and collapsing of rebounder 100. The first end of the second leg 126*b* is pivotally and/or slidingly connected to the first base member 104*a* via a sliding pivotal connector 117 through which base member 104*a* passes. The second end of each of the first and second legs 126*a*, 126*b* is connected to the cross member locking mechanism 128. The cross support locking mechanism 128 receives, spans between, and is pivotally connected to first support 124 and rigidly connected to the second end of each of the first and second legs 126*a*, 126*b*. Cross support locking mechanism 128 is actuatable between a locked position (where a spring biased detent button 128*a* extends through hole 128*b*) (FIGS. 7 and 8). Locking mechanism 128 also receives leg 126*a* and includes a pivot 129 attached to first support, such that locking mechanism pivots about pivot 129 upon rebounder 100 being collapsed. First and second legs 126*a*, 126*b* are fixed with respect to one another and the net is maintained in tension. To unlock, spring-biased locking button 128*a* is depressed into hole 128*b*, and when unlocked, the second ends of the first and second legs are fixed with respect to the cross support locking mechanism 128, and the tension of the net is reduced as compared to when the cross support locking mechanism is in the locking position.

Telescoping first and second side brace members 130, 132 are each pivotally connected to first side support 114 and second side support 116 respectively. First brace member 130 has a first end 130*a* pivotally connected to first side support 114 and pivotally and/or slidingly connected to base member 104*a* via a sliding pivoting connecter 117 that receives second base member 104*a* during set up and collapsing of rebounder 100. Second brace member 132 has a first end 132*a* pivotally connected to second side support 116 and is pivotally and/or slidingly connected to second base member 104*b* via a sliding pivoting connecter 117 during set up and collapsing of rebounder 100. With this configuration, upper frame 102 is adjustable relative to base frame 104 by the sliding and/or pivotal movement and/or adjustment of the second end 130*a* of first brace 130 and the second end 132*a* of second brace 132 with respect to first and second base members 104*a*, 104*b* respectively. For example, upper frame 102 may be angled relative to base frame 104 by adjusting the positioning of first and second support members 130, 132. Additionally, each of first and second side brace members 130, 132 include a first sleeve 133*a*, and a second sleeve 133*b* slidingly, or telescopingly, received within the first sleeve 133*a*, where the upper frame 102 is adjustable relative to the base frame 104 by telescoping of first and/or second sleeves 133*a*, 133*b* with respect to one another to adjust the overall length of the first and second brace members 130, 132, and where, as a consequence, the second end of each of the first and second brace members 130, 132 slides with respect to the first and second base members 104*a*, 104*b*, respectively, thereby allowing the upper frame 102 to be selectively angled relative to the base frame 104 by adjusting the effective length of at least one of the first and second brace members 130, 132. One or more releasable locking devices may be included, which may in an exemplary implementation comprise at least one spring-biased detent device 133*c*, configured for selectively engaging one or more holes in the first sleeve 133*a* in which the second sleeve is received, to thereby allow such second sleeve 133*b* to be selectively fixed with respective to the first sleeve and to thereby selectively fix the effective length of such first or second brace 130, 132.

To collapse rebounder 100, coupling 123 of locking mechanism 122 is released, or unlocked, by the user need by depressing the coupling 122 a sufficient distance, whereby the members 118, 120 are no longer in tension, at which point members 118, 120 may freely pivot downwardly in a folding manner as shown in FIG. 3. The user would also depress button 128*a* of cross support locking mechanism 128 into hole 128*b*, and when unlocked, the first support 124 is then pivotable with respect to the cross support locking mechanism 128. Cross supports 118, 120 are folded downwardly, causing the upper frame 102 to generally fold upon itself, cross members 124, 126 are drawn together and generally inwardly upon themselves, and base members 104*a*, 104*b* and side braces 130, 132 pivot upwardly and inwardly to be generally adjacent one another, where the collapsed rebounder's components are ultimately in a space-saving, readily transportable stacked, compact configuration, as shown in FIGS. 4 and 5.

Components of rebounder 100, including without limitation, upper frame 102, lower frame 104, cross supports 124, 126, and braces 130, 132, could be constructed of steel pipe or tubing, or any other suitable including metal, alloy, or material.

Accordingly, implementations are disclosed herein that provide a soccer rebounder that can be manipulated to be in a compact, space-saving configuration. Additionally, implementations are disclosed herein that provide a goal apparatus, for use in the training and/or play of other activities, such as hockey, lacrosse, etc., that can also be manipulated to be in a compact, space-saving configuration.

The above-disclosed features and functions, as well as alternatives, may be combined into many other different apparatuses or applications. Various presently unforeseen or unanticipated alternatives, modifications, variations or improvements may be made by those skilled in the art, each of which is also intended to be encompassed by the disclosed implementations.

What is claimed is:

1. An apparatus, comprising:

a base frame having a plurality of elongated base members including a first elongated base member and a second elongated base member;

a first sliding connector receiving the first elongated base member such that the first sliding connector is slidable along the first elongated base member;

a second sliding connector receiving the second elongated base member such that the second sliding connector is slidable along the second elongated base member;

an upper frame having:

a first elongated side support pivotally connected to the first elongated base member via a first pivotal connector;

a second elongated side support pivotally connected to the second elongated base member via a second pivotal connector;

an elongated upper support having a plurality of elongated upper support members, wherein a first end of the elongated upper support is pivotally connected to the first elongated side support and a second end of the elongated upper support is pivotally connected to the second elongated side support; and a first lock configured to pivotally join together the plurality of upper support members and configured to be selectively actuatable between a locked configuration to fix relative movement between the plurality of elongated upper support members and an unlocked configuration to allow folding movement of the plurality of upper support members relative to each other and relative to the first lock;

a first elongated cross member pivotally connected, at a first end, to the first elongated side support and the first elongated base member via the first pivotal connector, and pivotally connected, at a second end, to the second sliding connector;

a second elongated cross member comprising a first leg and a second leg, the second leg axially offset from the first leg, the first leg pivotally connected to the second elongated side support and the second elongated base member of the base frame via the second pivotal connector, and the second leg pivotally connected to the first sliding connector;

a first elongated brace (a) pivotally connected to the first elongated side support at a first position between the first pivotal connector and the first end of the elongated upper support and (b) pivotally connected to the first sliding connector;

a second elongated brace (a) pivotally connected to the second elongated side support at a second position between the second pivotal connector and the second end of the elongated upper support and (b) pivotally connected to the second sliding connector; and a second lock pivotally connected to the first elongated cross member, and rigidly connected to the second elongated cross member, and configured to be selectively actuatable between (a) a locked configuration to fix relative movement between the first elongated cross member and the second elongated cross member and (b) an unlocked position to allow drawing together of the cross members.

2. The apparatus of claim 1, wherein upon the first lock being in the unlocked configuration and the second lock being in the unlocked configuration, the first elongated side support and the second elongated side support are configured to be substantially folded together, the first elongated cross member and the second elongated cross member are configured to be drawn together, the first elongated base member and the second elongated base member are configured to be drawn substantially together, and the plurality of elongated upper support members are configured to be drawn substantially together.

3. The apparatus of claim 1, wherein the at least one elongated brace is configured to be selectively extendable along its length.

4. The apparatus of claim 3, wherein the at least one elongated brace is configured to selectively telescope in length.

5. The apparatus of claim 1, further comprising a net connected to the upper frame.

6. An apparatus, comprising:

an upper frame configured to define an opening;

a base frame having an elongated first base member connected to the upper frame via a first pivotal connector and an elongated second base member connected to the upper frame via a second pivotal connector;

a first sliding connector receiving the elongated first base member such that the first sliding connector is slidable along the elongated first base member;

a second sliding connector receiving the elongated second base member such that the second sliding connector is slidable along the elongated second base member;

the upper frame including:

an elongated upper support having a first end and a second end opposite the first end;

an elongated first side support; and an elongated second side support;

the first end of the elongated upper support being pivotally connected to the elongated first side support;

the second end of the elongated upper support being pivotally connected to the elongated second side support;

each of the elongated first side support and the elongated second side support being configured to move between a first position substantially perpendicular to the elongated upper support and a second position generally parallel to at least a portion of the elongated upper support;

the elongated first side support being configured to move between a first position substantially perpendicular to or at an acute angle with respect to the elongated first base member and a second position generally parallel to the elongated first base member;

the elongated second side support being configured to move between a first position substantially perpendicular to or at an acute angle with respect to the elongated second base member and a second position generally parallel to the elongated second base member;

a first elongated cross member pivotally connected, at a first end, to the elongated first side support and the elongated first base member of the base frame, via the first pivotal connector, and coupled to the second sliding connector such that the first elongated cross member is slidingly connected, at a second end, to the elongated second base member of the base frame, the first elongated cross member including a spring biased detent button positioned along a length thereof;

a second elongated cross member comprising a first leg and a second leg, wherein the second leg is axially offset from the first leg, the first leg pivotally connected to the elongated second side support and the elongated second base member of the base frame via the second pivotal connector, and the second leg coupled to the first sliding connector such that the second leg is slidingly connected to the elongated first base member of the base frame;

a first brace (a) pivotally connected to the elongated first side support at a first position between a lower end and an upper end thereof and (b) pivotally connected to the first sliding connector;

a second brace (a) pivotally connected to the elongated second side support at a second position between a lower end and an upper end thereof and (b) pivotally connected to the second sliding connector; and a cross-support locking mechanism pivotally connected to the first elongated cross member and rigidly connected to the first leg and the second leg, the cross-support locking mechanism defining an aperture, wherein the spring biased detent button of the first elongated cross member is positioned to selectively engage with the aperture of the cross-support locking mechanism to pivotally fix the first elongated cross member with the cross-support locking mechanism;

wherein the elongated first base member opposes the elongated second base member.

7. The apparatus of claim 6, wherein the upper frame is configured to selectively extend perpendicularly with respect to the base frame, at an acute angle with respect to the base frame, and substantially parallel to the base frame.

8. The apparatus of claim 6, wherein the elongated first side support is configured to move to a third position where the elongated first side support extends substantially parallel to the elongated first base member.

9. The apparatus of claim 6, wherein the elongated second side support is configured to move to a third position where the elongated second side support extends substantially parallel to the elongated second base member.

10. The apparatus of claim 6, wherein the elongated upper support includes:

an elongated first upper support member and an elongated second upper support member, each of the elongated first upper support and the elongated second upper support member having a first end and a second end opposite the first end, the first end of the elongated first upper support being connected to the elongated second side support member; and an upper support locking mechanism pivotally connected to the second end of the elongated first upper support member and the second end of the elongated second upper support member, the upper support locking mechanism being configured to be actuatable between a locked position where the elongated first upper support member and the elongated second upper support member are fixed with respect to one another, and an unlocked position where at least one of the second end of the elongated first upper support member or the second end of the elongated second upper support member is pivotable with respect to the upper support locking mechanism.

11. The apparatus of claim 10, wherein the upper support locking mechanism is a selectively actuatable toggle mechanism.

12. The apparatus of claim 6, wherein each of the first brace member and the second brace has a first sleeve and a second sleeve slidingly received within the first sleeve configured to allow the length of each of the first brace and the second brace to be selectively adjusted.

13. The apparatus of claim 12, wherein at least one of the first brace or the second brace has a lock device for selectively fixing the first sleeve with respect to the second sleeve.

14. The apparatus of claim 6, further comprising a net configured to be connected to the upper frame and to span across the opening and to rebound an object.

15. An apparatus, comprising:

a first base member;

a second base member;

a first sliding connector receiving the first base member such that the first sliding connector is slidable along the first base member;

a second sliding connector receiving the second base member such that the second sliding connector is slidable along the second base member;

a first pivotal connector connected to an end of the first base member;

a second pivotal connector connected to an end of the second base member;

a first side support pivotally having a lower end and an upper end, the lower end of the first side support pivotally connected to the first pivotal connector;

a second side support having a lower end and an upper end, the lower end of the second side support pivotally connected to the second pivotal connector;

an upper support extending between the upper end of the first side support and the upper end of the second side support;

a first cross member extending between the first pivotal connector and the second sliding connector;

a second cross member extending between the second pivotal connector and the first sliding connector;

a first brace (a) pivotally connected to the first side support at a first position between the lower end and the upper end thereof and (b) pivotally connected to the first sliding connector;

a second brace (a) pivotally connected to the second side support at a second position between the lower end and the upper end thereof and (b) pivotally connected to the second sliding connector.

16. The apparatus of claim 15, wherein the upper support includes a hinge element positioned proximate a center thereof.

17. The apparatus of claim 15, further comprising a cross-support locking mechanism pivotally connected to the first cross member and rigidly connected to the second cross member, wherein the cross-support locking mechanism defines an aperture, wherein the first cross member includes a spring biased detent button positioned along a length thereof, and wherein the spring biased detent button of the first cross member is positioned to selectively engage with the aperture of the cross-support locking mechanism to pivotally fix the first elongated cross member with the cross-support locking mechanism.

* * * * *